United States Patent [19]

Parker

[11] 4,107,361

[45] Aug. 15, 1978

[54] NEEDLE-PUNCHED GRASS-LIKE CARPETS

[75] Inventor: Phillip H. Parker, San Rafael, Calif.

[73] Assignee: Chevron Research Company, San Francisco, Calif.

[21] Appl. No.: 545,443

[22] Filed: Jan. 30, 1975

[51] Int. Cl.[2] ..... B32B 3/02; B32B 33/00

[52] U.S. Cl. ..... 428/17; 264/147; 264/156; 264/210 R; 264/216; 264/288; 264/289; 428/85; 428/91; 428/95; 428/215; 428/216; 428/220; 428/234; 428/286; 428/287; 428/300

[58] Field of Search ..... 428/17, 85, 91, 234, 428/286, 287, 300, 215, 216, 95, 220; 264/288, 289, 210 R, 216, 156, 147; 28/72.2 R

[56] References Cited

U.S. PATENT DOCUMENTS

| | | | |
|---|---|---|---|
| 3,496,259 | 2/1970 | Guenther | 264/156 |
| 3,496,260 | 2/1970 | Guenther | 264/156 |
| 3,550,826 | 12/1970 | Salmela | 225/3 |
| 3,619,460 | 11/1971 | Chill | 264/288 |
| 3,695,962 | 10/1972 | Oosterlynck | 428/85 |
| 3,822,173 | 6/1974 | Graber | 428/85 |

FOREIGN PATENT DOCUMENTS 6,805,631 10/1969 Netherlands.

*Primary Examiner*—Marion E. McCamish
*Attorney, Agent, or Firm*—Dix A. Newell; Thomas G. DeJonghe; Lawrence S. Squires

[57] ABSTRACT

A grass-like carpet comprises 1-20 plies of a fibrous web needle-punched into a substrate. The fibrous web is made from a uniaxially oriented polymer film.

10 Claims, No Drawings

NEEDLE-PUNCHED GRASS-LIKE CARPETS

BACKGROUND OF THE INVENTION

Needle-punched carpets have heretofore been produced by feeding fiber onto a scrim, i.e., a woven or non-woven carpet backing made of jute, polyolefin, glass fibers, etc. The fiber is then needled into the scrim on a needle-loom. The needle-loom operates by simply oscillating a board covered with split or barbed needles in a vertical direction through the fiber and scrim. The needles entangle the fiber into the carpet backing to produce a carpet material. A difficulty of the method is the need to provide fibers in a reasonably loose condition for uniform production of the carpet.

Grass-like carpets have been made in the prior art from a fibrillated polymer film (fibrous web) by splitting said web into narrow strips and twisting the strips at about two turns per inch to give a pile-yarn suitable for making carpets. This pile-yarn is then secured into a conventional substrate of material or synthetic material and either left uncut, or preferably at least partially cut to give a grass-like appearance. By means of these numerous steps, a grass-like carpet is produced.

SUMMARY OF THE INVENTION

A needle-punched grass-like carpet comprises 1–20 plies of fibrous web needle-punched into a substrate. The fibrous web is produced by fibrillating a uniaxially oriented polymer film. In this invention, the sheet (s) of fibrous web is lapped in 1–20 plies over a base material which provides the substrate for the carpet and needle-punched to produce a highly uniform grass-like carpet without the need for slitting and twisting the fibrous web into a fibrillating yarn for carpet making.

PREFERRED EMBODIMENTS OF THE INVENTION

A carpet comprising 1–20 plies (layers) of a fibrous web, which is a fibrillated uniaxially oriented polymer film, on a substrate. The fibrous web is attached to the substrate by penetrating (punching) said web and substrate with barbed, or split, protrusions (needles or pins). Preferably there are from about 10 to about 500 penetrations per square inch of carpet surface area.

U.S. Pat. No. 3,496,259, issued to L. M. Guenther, describes a process for preparing fibrous web by fibrillating uniaxially oriented polymer film by feeding the film under tension between the rotating surfaces of the toothed roller having parallel, helical rows of teeth and a presser roller having helical grooves which are complementary to the teeth rows and meet with the teeth rows, rotating the toothed roller and presser roller in opposite directions, substantially synchronously, at peripheral speeds about 1.5 to 20 times greater than the film speed, forcing the teeth through the film and into the grooves and withdrawing the fibrous web as a sheet from the toothed and presser rollers. The disclosure of U.S. Pat. No. 3,496,259 is herein incorporated by reference.

In U.S. Pat. No. 3,496,260, issued to L. M. Guenther, G. B. Johnson and A. L. Meader, a process is described for preparing a fibrous web by fibrillating a uniaxially oriented flat polymer film of substantially uniform thickness. This process comprises passing the film between th contra-rotating circumferential surfaces of a driven roller covered with regularly spaced, sharp, stiff protrusions, e.g., card clothing, whose peripheral speed is about 2 to 20 times the film speed, and a presser roller while applying sufficient pressure to the film with the presser roller to cause the protrusions to puncture the film, thereby cutting elongated slits in the film. The slit polymer film can be used as a fibrous web in the present invention. The disclosure of U.S. Pat. No. 3,496,260 is herein incorporated by reference.

In U.S. Pat. No. 3,550,826, issued to J. M. Salmela, there is disclosed a process for preparing fibrous web from uniaxially oriented polymer film by feeding the film under slight tension between the rotating surfaces of a first roller having parallel, longitudinal, elevated rows of cutting elements on its circumferential surface and a second roller having parallel longitudinal grooves on its circumferential surface which are complementary to and mesh with the rows of cutting elements. The two rollers rotate in opposite directions substantially synchronously at peripheral speeds about 1.5 to 20 times greater than the film speed. As they rotate, the rows of cutting elements are forced through the film and enter the second roller's grooves. Thus, the film is slit and thereafter withdrawn from the rollers. The slit polymer film is embodied as a fibrous web in the present invention. Preferably the grooves of said second roller are filled with a resilient material such as a rubber or polyurethane. The disclosure of U.S. Pat. No. 3,550,826 is herein incorporated by reference. Other methods of fibrillating polymer film to a fibrous web of this kind can also be utilized.

FIG. 3 of U.S. Pat. No. 3,496,260, FIG. 5 of U.S. Pat. No. 3,496,259 and FIGS. 4 and 5 of U.S. Pat. No. 3,550,826 illustrate fibrous webs which find use in producing the needle-punched grass-like carpet of the present invention. It is noted that the fibrous web is made-up of bands or ribs interconnected by fibrils.

U.S. Pat. No. 3,619,460, issued to L. Chill, discloses a process for uniaxially orienting polypropylene film between rollers to draw ratios in the range of 6:1 up to fibrillation. This and other methods of orientation of polymer films are utilized in forming the oriented film of the present invention. The general technology for preparing the film used in this process is well known in the art. The polymer is extruded in a conventional extruder to provide a film of desired thickness and width. For convenience, the very wide film may be extruded and then slit and trimmed to the desired width. The film may by oriented by drawing it at an elevated temperature, with draw temperatures depending on the polymer used. The film is normally heated to the desired temperature by passing it through a heated zone or over heated rolls or drums. It may be drawn in a single step or in a plurality of steps. The particular draw ratios used to orient the film will be ultimately at least about 4:1 and may extend to a ratio below that which causes the film a fibrillate spontaneously. The ultimate draw ratio in a given instance will again depend on the polymer used. For instance, draw ratios between 5:1 to 10:1, preferably 7:1 to 9:1, are desirable for normally solid, substantially crystalline polypropylene.

The film thickness should be chosen to correspond to the fineness desired in the fibrous webs. Generally, the oriented film thickness will be between about 0.3 and 3 mils, preferably 0.5 to 2 mils. Lower thicknesses within this range are used to make fine products, while thicknesses in the upper portion of this range give coarser materials. Mixtures of films of more than one thickness may also be used to obtain an esthetic effect.

The polymers which may be used to prepare these films are orientable, normally solid, crystalline polymers and copolymers. Typical examples of such polymers are high-density polyethylene, polypropylene, poly-1-butene, poly-4-methyl-1-pentene, polyesters, polyamides, e.g., the nylons and the like. Mixtures of such polymers, or mixtures of fibrous webs produced from such polymers, may be used, if desired. For example, copolymers of ethylene and propylene may be used to produce the fibrous web, or alternate plies of polypropylene and polyethylene fibrous webs may be used in needle-punching the carpet. These polymers may also contain additives such as photostabilizers, antioxidants, heat stabilizers, dye acceptors, pigments, dyes, fillers, and the like.

Preferably the film is a poly-1-olefin and most preferably it is polypropylene. The normally solid, substantially crystalline poly-1-olefins are well-known commercial commodities. Such polymers include Ziegler polyethylene, high-density polyethylene, stereoregular poly(butene-1), poly(4-methylphentene-1), etc. For present purposes, the stereoregular, normally solid, substantially crystalline polypropylene is preferred. Such polypropylene is advantageously utilized for producing a grass-like carpet. Such polypropylene is normally at least about 50% crystalline in character and is essentially insoluble in refluxing heptanes.

In the preferred embodiment, the fibrous web is made by fibrillating a uniaxially oriented polymer film of substantially uniform thickness by feeding the film under tension between the rotating surfaces of a toothed roller and a presser roller. The toothed roller has substantially parallel rows of substantially equidistant teeth, i.e., sharp, stiff protrusions, which act as cutting elements, in a substantially uniform pattern on its circumferential surface. Preferably said presser roller has substantially parallel grooves communicable with said rows of teeth. The toothed roller and presser roller rotate substantially synchronously at peripheral speeds 1.5 to about 20 times greater than the film speed, forcing the teeth through the film and into respective communicating grooves of the presser roller so as to cut elongated slits in the film. Preferably the grooves are filled with a strong resilient material such as plastic, rubber or polyurethane.

Needle-punching is accomplished by the same machines as are currently used in the textile art. Needle-punching machines are essentially multiheaded, threadless sewing machines that punch a board uniformly populated with split or barbed needles up and down through the fibrous web and the substrate. Needle-punching may be accomplished once or in several steps. In a separate step, the backside of the carpet may be coated or treated to provide a secure finish to the carpeting. Such treatment includes coating with latex, polyurethane, asphalt, etc.

In the preferred embodiment of the present invention, the carpet is a needle-punched grass-like carpet. A needle-punched grass carpet refers to a carpet and a method for making same, which is grass-like in appearance and is made by needle-punching one or more sheets of fibrous web into a base material which provides the substrate for the carpet. In this way, the slitting and twisting necessary to make fibrillated yarn are avoided. Several plies of fibrous web are preferred to just one layer.

Preferably from 1 to about 20 plies, more preferably 1 to about 10 plies and most preferably 2 to about 5 plies of fibrous web are used. The number of needles in the needle-punching loom is preferably from about 10 to about 500 per square inch. The needles penetrate the substrate to an extent dependent on the thickness of the substrate and the length of the needle stroke. Penetration of the substrate will normally be to the extent of at least about 0.05 to about 1 inch and the stroke will normally be from about 0.1 to several inches in length. The needle loom will usually perform from 60 to about 500 strokes per minute. The carpet is advanced at a rate of from about 0.1 to several inches per stroke in the loom. The needle-punching may be repeated once or several times with changing needle stroke length, penetration and rate of advance to achieve the desired product, usually from 1 to 10, preferably from 1 to 3, needle treatments will suffice.

The base materials which find use within the scope of the present invention as substrates for the needle-punching of the fibrous webs include any material known to the art which is suitable for use as carpeting or as a substrate for needle-punching. Such materials are easily penetrable by the needles, and are of a character which lends strength and stability to the carpet. The substrate will have a thickness of from about 0.05 to about 1 inch. Preferred substrates include scrims, felts and ordinary carpet backing; woven and nonwoven felts, textiles and films. Needle-punched substrates such as those made from a web of staple fiber are also preferred. Base materials are made from natural fibers and man-made fibers and films, such as nylon, polyester, and polyolefin.

A primary quality of a needle-punched grass-like carpet is, of course, its grass-like appearance. Additional important qualities include dimensional stability, abrasion resistance, stability towards exposure to sunlight, resistance to oxidation, stain resistance, and antistatic property. The thickness and appearance of the needle-punched grass-like carpet are primarily determined by the number of plies or laps of fibrous web which are needle-punched into the substrate. Normally, 1–20 plies of fibrous web are used, but 2–12 plies are preferred, and 5–10 plies are most preferred.

EXAMPLES

Example 1

Ten sheets of green fibrous web made from extruded and uniaxially oriented polypropylene film (see U.S. Pat. No. 3,496,259), each 8½ inches square by 1 mil thick and having 50±1 fibril counts per inch (U.S. Pat. No. 3,496,259, Col. 6, lines 29–31), were placed atop one another. The stacked fibrous webs are then placed on a substrate consisting of a commercial needle-felted carpet made from polypropylene fiber. The needle-felted substrate was made by needle-punching a web of polypropylene staple fiber into a scrim of woven polyporpylene. The resulting assembly was needle-punched on a Hunter Fiber/Locker laboratory needle punching machine having 77½ needles per inch of width. The needles were Torrington felting needles No. 77-0750-10-1 (15×18×20×3 RB sq. cor. crk.). The needle-punching machine was adjusted for ½ inch advance per stroke and for ½ inch needle penetration. The backside of the carpet was then coated with a commercial rubber latex. After curing, the product was a surface covering or carpet having the appearance of a dense, moderately flattened grass lawn with leaves 0.02 inch wide and 0.001 inch thick.

EXAMPLE 2

Five plies of green fibrous web polypropylene film, as in Example 1, were placed on a substrate as in the previous example, but in this case the substrate was a thin scrim of woven polypropylene. The 5-ply assembly was passed through the needle-punching machine twice. The product was the same as in Example 1, except it was somewhat less dense in appearance.

The above process for producing a grasslike carpet has the advantage over conventional grass-like carpets and their methods of making, in that the face yarn does not have to go through the steps of tufting and cutting. On the other hand, as compared to needle-punching a staple yarn in the same way to make grasslike carpets, the present process produces a more grass-like appearance as well as avoiding the steps of cutting, baling, opening and carding, all required in handling staple.

What is claimed is:

1. A carpet having a grass-like appearance comprising 1–20 plies of a fibrous web, consisting of ribs interconnected by fibrils, and made by fibrillating a film having a thickness of about 0.3 to 3 mils, needle-punched into a non-fibrillated substrate having a thickness of about from 0.05 to 1 inch and wherein said needle-punched fibrous web forms the pile of said carpet and has a grass-like appearance and wherein said substrate strengthens and stabilizes said carpet.

2. A carpet according to claim 1 wherein said polymer is a poly-1-olefin.

3. A carpet according to claim 2 wherein said poly-1-olefin is polypropylene.

4. A carpet according to claim 1 wherein said polymer film is uniaxially oriented at a draw ratio of about 5:1 to 10:1.

5. A carpet according to claim 1, wherein said fibrous web is made from a uniaxially oriented polymer film by feeding the film under tension between the rotating surfaces of a toothed roller and a presser roller, the toothed roller having substantially parallel rows of substantially equidistant teeth, or sharp, stiff protrusions, which act as cutting elements, arranged in a substantially uniform pattern on its circumferential surface, said presser roller having substantially parallel grooves communicable with said rows of teeth, the toothed roller and presser roller rotating substantially synchronously at peripheral speeds 1.5 to 20 times greater than the film speed, forcing the teeth through the film and into respective communicating grooves so as to cut elongated slits in the film.

6. A carpet according to claim 5 wherein said presser roller grooves are filled with a strong resilient material.

7. The carpet of claim 1 wherein said substrate is felt.

8. The carpet of claim 1 wherein said substrate is scrim.

9. The carpet of claim 1 wherein said carpet has 5–10 plies of said fibrous web.

10. A process for producing a carpet having a grass-like appearance comprising the steps of feeding a uniaxially oriented polymer film, having a thickness of about from 0.3 to 3 mils under tension between the rotating surfaces of a toothed roller and a presser roller, the toothed roller having substantially parallel rows of substantially equidistant teeth, or sharp, stiff protrusions, which act as cutting elements, arranged in a substantially uniform pattern on its circumferential surface, said presser roller having substantially parallel grooves communicable with said rows of teeth, the toothed roller and presser roller rotating substantially synchronously at peripheral speeds 1.5 to 20 times greater than the film speed, forcing the teeth through the film and into respective communicating grooves so as to cut elongated slits in the film to produce a fibrous web consisting of ribs interconnected by fibrils, and needle-punching 1–20 plies of said fibrous web into a non-fibrillated substrate having a thickness of about from 0.05 to 1 inch.

* * * * *